US005518067A

United States Patent [19]

Finch et al.

[11] Patent Number: 5,518,067

[45] Date of Patent: May 21, 1996

[54] SCRAPED SURFACE HEAT EXCHANGER

[75] Inventors: David G. Finch, Basingstoke; Nicholas S. Hall-Taylor, Cranbrook, both of United Kingdom

[73] Assignee: Crown Chemtech Limited, Berkshire, United Kingdom

[21] Appl. No.: 287,904

[22] Filed: Aug. 9, 1994

Related U.S. Application Data

[63] Continuation-in-part of Ser. No. 262,479, Jun. 20, 1994, abandoned, which is a continuation-in-part of Ser. No. 14,109, Feb. 5, 1993, abandoned.

[30] Foreign Application Priority Data

Feb. 5, 1992 [GB] United Kingdom ..... 9202409

[51] Int. Cl.[6] ..... F28F 5/06; F28G 3/10

[52] U.S. Cl. ..... 165/92; 165/94; 165/DIG. 83; 165/DIG. 84; 165/DIG. 90

[58] Field of Search ..... 165/87, 92, 94, 165/DIG. 83, DIG. 84, DIG. 90, DIG. 91; 62/354

[56] References Cited

U.S. PATENT DOCUMENTS

| | | | |
|---|---|---|---|
| 735,873 | 8/1903 | Hatton | 165/87 |
| 1,902,295 | 3/1933 | Shook | 165/87 |
| 1,949,374 | 2/1934 | Johnson | 165/87 X |
| 2,589,350 | 3/1952 | Edmunds, Jr. | 165/94 |
| 4,073,339 | 2/1978 | D'Orsay | 165/94 |
| 4,538,428 | 9/1985 | Wilkerson | 62/354 |
| 5,165,469 | 11/1992 | Smith | 165/94 |

FOREIGN PATENT DOCUMENTS

| | | | |
|---|---|---|---|
| 400700 | 12/1990 | European Pat. Off. . | |
| 3939778 | 6/1991 | Germany . | |
| 613387 | 12/1960 | Italy | 165/94 |

*Primary Examiner*—Allen J. Flanigan
*Attorney, Agent, or Firm*—Nawrocki, Rooney & Sivertson

[57] ABSTRACT

A scraped surface heat exchanger comprises a pair of concentric heat exchange tubes. A heat exchange medium passes through the annular chamber between the tubes and a fluid, in particular one whose viscosity increases as it passes through the heat exchanger and whose temperature is to be modified by heat exchange with the heat exchange medium in the annular chamber, passes through the inner of the tubes. A helical scraper blade arrangement extends along the length of the shaft within the inner chamber. The scraper blade arrangement comprises one or more thin plastics or metal blades set within a helical slot which is angled against the direction of flow of the fluid medium and makes with the internal surface of the inner tube a contact sufficient to allow the blade arrangement to rotate within the inner tube when conveying through it the fluid whose temperature is to be modified.

9 Claims, 3 Drawing Sheets

SCRAPED SURFACE HEAT EXCHANGER

CROSS REFERENCE TO COPENDING APPLICATIONS

This application is a continuation-in-part of U.S. application Ser. No. 08/262,479 which was filed on Jun. 10, 1994, now abandoned which is a continuation of U.S. application Ser. No. 08/014,109 which was filed on Feb. 5, 1993, now abandoned.

This invention relates to scraped surface heat exchangers and more particularly heat exchangers of such type for use in the heating of viscous fluids.

A common type of heat exchanger is one comprising a pair of concentric tubes with a medium whose temperature is to be changed passing through the inner tube and a heating or cooling medium passing through the gap between the two tubes. To ensure that fresh material for undergoing heat exchange is constantly introduced to the heat transfer surface, i.e. the internal surface of the inner tube, and at the same time to ensure that cooled or heated material is removed from the vicinity of this transfer surface, one or more scraper blades carried on a central shaft is/are rotated within the inner of the two concentric tubes. Although any such blade is generally angled to the transfer surface, the rotational movement of the blade is essentially a radial extension of the rotated movement imparted by means of drive means to the central shaft.

Although termed scraper blades, it is emphasized that the primary function of the blades is as already stated. Heat exchangers with such blades are generally not required to effect any significant removal from the internal surface of the inner tube of scale or other deposits such as may form thereon with continued use of those heat exchangers in which cooling of fluids from which solids may deposit is to be effected. If the medium being heated were scale forming, if anything the design of such scraper blades would be such that they might even cease to function. Indeed there have been devised more satisfactory types of heat exchanger where scale deposit is a particular problem and removal of material which has already undergone heat exchange from the vicinity of the exchanger surface is less of a problem. One such arrangement is described in EP-A-369 851 and comprises a helical element mounted in a heat exchanger tube for free rotation therein driven by the introduction of fluid into the chamber for undergoing heat exchange. The surface of the helical blade most remote from the axis of rotation thereof is sharpened to achieve scraping of scale from the internal surface of the heat exchange tube as the blade rotates.

Conventional scraped surface heat exchangers to be utilised particularly where scale formation is not a problem nevertheless give rise to difficulties in the cooling of viscous materials. A difficulty here is that as the temperature falls, the viscosity of the material increases. At the same time the heat generated within the stirred material increases as the viscosity increases. Thus a situation can arise towards the cooler end of the heat exchanger where the cooling effect of the heat exchanger is largely countered by the viscous heat generation caused by the stirring action. In other words, no longer is there possible a significant net cooling effect.

A further problem is that, in order to maintain the throughput of viscous fluid through a heat exchanger, it is subjected to a predetermined pressure as it is fed into the heat exchanger. As the viscosity increases through the heat exchanger's length, so does the pressure drop observed within the fluid undergoing heat exchange increase. Consequently the pressure generated by the feed pump has to be increased and as a consequence the designed operating pressure of the scraped surface heat exchanger has to be increased. This necessitates increasing the wall thickness of the inner tube leading, in consequence, to a reduction in the rate of heat transfer.

It is an object of this invention to provide a means of achieving enhanced cooling of viscous media passing through tube heat exchangers while avoiding as much as possible the aforementioned difficulties.

According to one aspect of the present invention, there is provided a scraped surface heat exchanger comprising a pair of concentric heat exchanger tubes with a scraper blade-carrying shaft being disposed axially within the inner of the tubes and adapted for connection to rotational drive means, inlet and outlet means being provided to both a chamber defined by the inner tube and to an annular chamber formed between the two tubes, in which heat exchanger a helical scraper blade arrangement extends along the length of the shaft within the inner chamber, which blade arrangement includes a helical slot angled against the direction of flow of the fluid medium provided on said shaft and in which is set thin strip-form metal or plastics material which presses against the internal surface of the inner tube with a contact sufficient to allow the shaft to rotate within the inner tube when the blade arrangement is conveying through the inner tube a fluid medium to undergo heat exchange with a heat exchange medium in the outer chamber.

According to a second aspect of the invention, there is provided a method of affecting heat exchange between a heat exchange medium and a medium which is to undergo heat exchange with such medium in a heat exchanger under conditions such that the latter medium will increase in viscosity as it passes through the heat exchanger, which comprises conveying the latter medium through the interior of the inner of a pair of concentric tubes between which flows a heat exchange medium, under the action of a rotating helical scraper blade arrangement against one surface of which the fluid medium presses, said one surface being provided by thin strip-form metal or plastics material set in a helical slot on a shaft carrying the blade arrangement, the slot being angled against the direction of flow of the fluid medium and said thin strip-form metal or plastics material making intimate contact with the inner wall surface of the inner of the concentric tubes.

The apparatus used in carrying out the present invention will differ from that conventionally employed mainly in respect of the blade provision within the inner chamber. Thus, the conventional essentially flat scraper blades are replaced by a single or preferably a set of multi-start helically wound fins on the rotating shaft within the inner chamber. These are designed to include a normally replaceable thin strip of metal or plastics which provides a close contact between the top of the flights of the helical blade(s) and the inner surface of the inner tube. This maintains the advantage, of the scraped surface action, although at a slightly lower efficiency, while, however, ensuring that the material being conveyed is successfully carried right through the heat exchanger. The consequent advantages of this arrangement are:

1. The heat exchanger is less sensitive than hitherto to the effects of increase in viscosity occurring as material is passing through the inner chamber, concomitant with reduction in temperature.

2. A low pressure feed pump is sufficient for feeding material to the heat exchanger.
3. The heat exchange unit does not have to be designed for high pressure operation. This means that the inner tube wall in the heat exchanger can be relatively thin and hence the heat transfer effect is enhanced at all positions along the heat exchanger.

The heat exchange effect may indeed be enhanced by utilizing a hollow shaft which allows cooling/heating medium to be passed within the shaft close to the material to be cooled or heated as the shaft rotates. This effectively increases the available heat transfer surface although the heat transfer efficiency is lower at the shaft surface than at the wall dividing the inner and outer chambers. This lowered efficiency can nevertheless be improved to some extent by coating the shaft/material interface with a low friction material such as polytetrafluoroethylene.

For better understanding of the invention and to show how the same can be carried into effect, reference will now be made by way of example only to the accompanying drawings wherein.

Figure 1:
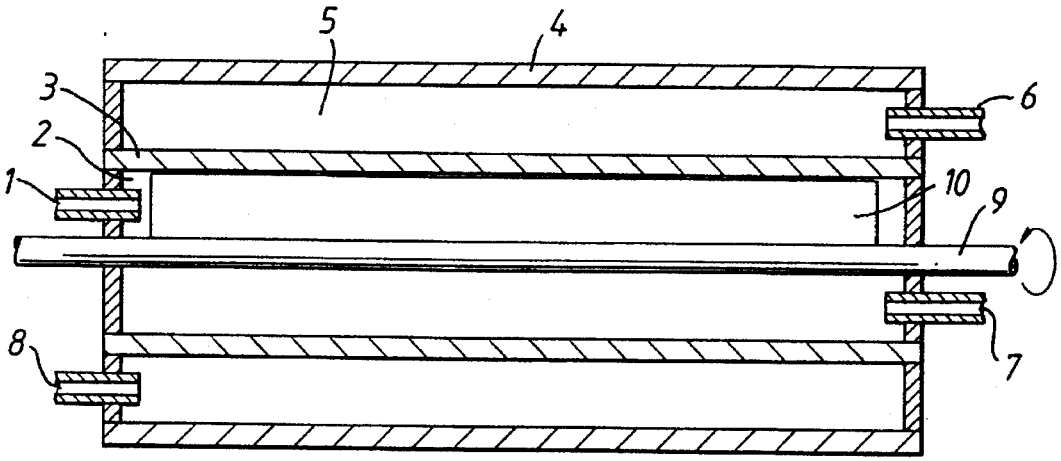
FIG. 1 is a longitudinal section through a prior art type of scraped surface heat exchanger.

Referring to FIG. 1 of the drawings, the heat exchanger shown diagrammatically therein is designed for supply of medium to be heated or cooled through an inlet pipe 1 into the interior 2 of the inner tube 3 of a pair of concentric tubes of which the outer tube 4 has a diameter such as to define an annular chamber 5 between the outer tube and the inner tube for throughflow of heat exchange medium to be introduced through inlet pipe 6 to flow in the opposite direction to the material introduced through pipe 1. An outflow pipe 7 serves for removal from the interior 2 of the inner tube 3 of material which has undergone heat exchange with the heat exchange medium and a pipe 8 serves for removal of heat exchange medium from the annular chamber 5. Passing along the axis of the arrangement and more particularly the centre line of inner tube 3 is a shaft 9 connected at its ends to appropriate drive means (not shown) and which carries within the tube 3 a plurality of radial scraper blades 10 of which only one is shown and which have a diameter such as to make contact with the internal surface of tube 3. The drive means for the shaft and closure means for the ends of the respective tubes 3 and 4 may be of conventional design and do not require discussion here.

Figure 2:
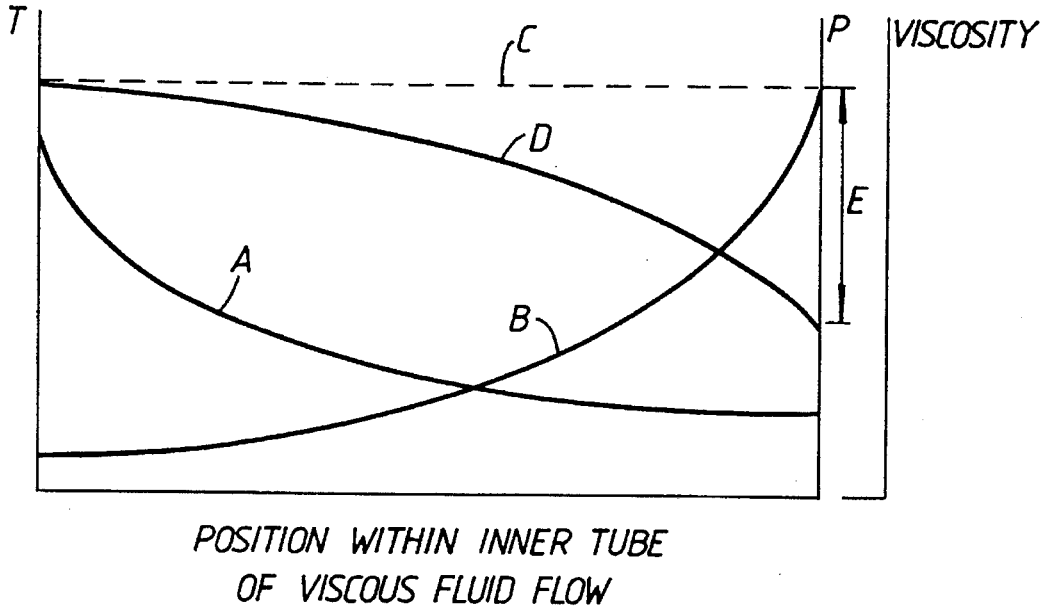
FIG. 2 is a graph showing on shared axes the typical changes in temperature and pressure experienced along the length of such heat exchanger.

FIG. 2 is aligned with the heat exchanger of FIG. 1 and shows in a very general manner the temperature change which is experienced by a viscous fluid introduced into the heat exchanger of FIG. 1 through pipe 1 to undergo cooling as it travels the length of tube 3. As it travels through tube 3 and is undergoing cooling by the heat exchange medium flowing in the opposite direction through the interior of tube 4, heat exchange initially takes place with the heat exchange medium while the latter is at its highest temperature, with more effective cooling taking place at the right hand end of the heat exchanger where the heat exchange medium, having Just been introduced, is at its coolest. This would be expected to mean that the temperature of fluid within the inner tube would decrease at an ever increasing rate along the length of the heat exchanger. However, with a viscous fluid, because viscosity of the material increases as the temperature falls and at the same time the heat generated within the stirred material increases as the viscosity increases, instead of increased rate of cooling with travel through the heat exchanger, the rate of cooling decreases and indeed the temperature of the viscous material increases at least in the latter part of its travel through the heat exchanger and eventually a point is reached at which no further change in temperature occurs since the rate of cooling is balanced by the viscous heat generation in the material to be cooled. This temperature behaviour is represented by curve A in FIG. 2. The viscosity behaviour is represented by curve B in FIG. 2.

Ideally, the pressure to which the viscous medium is subject as it passes through the heat exchanger should remain constant as represented by curve C. However, as the viscosity increases, there is a pressure drop as shown in curve D and in consequence, if a constant rate of flow of increasingly viscous material through the heat exchanger is to be maintained, the operating pressure, i.e. the feed pressure of the viscous medium has to be increased by an amount E. In practice this means simply that the feed pump has to operated with a considerably greater feed pressure than might be required for media which do not undergo viscosity increase along the length of the inner tube 3 of the heat exchanger.

Figure 3:
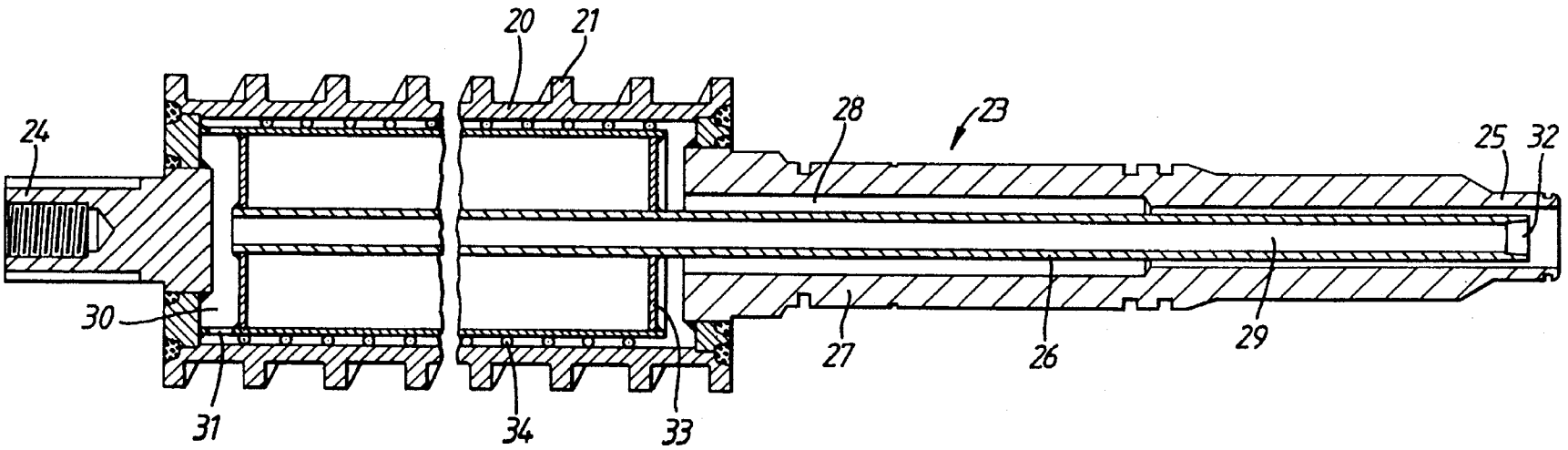
FIG. 3 is a longitudinal section through those components in a heat exchanger embodying the invention which are near the longitudinal axis thereof.
Figure 4:
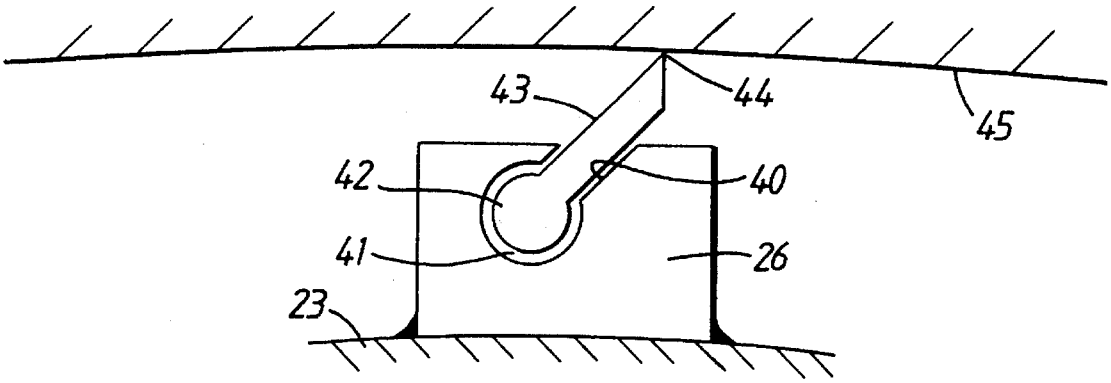
FIG. 4 is a detail of a helical blade of the heat exchanger of FIG. 3.
Figure 5:
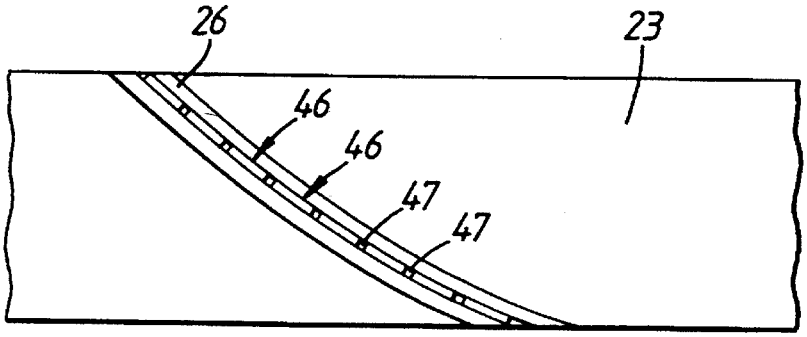
FIG. 5 is a plan view of part of a helical blade carrying shaft of the heat exchanger of FIG. 3.

It is with a view to avoiding the difficulties of employing a heat exchanger of the type shown in FIG. 2 with viscous fluids that it is proposed according to the invention to replace the arrangements of blades 10 on shaft 9 which makes no contribution to the conveying of a viscous fluid through the heat exchanger with the arrangement shown in FIGS. 3 to 5. To enhance the conveying of the viscous medium through the interior of a heat exchanger of the type shown in FIG. 2, the shaft 9 is in fact, here shown to be replaced by a composite arrangement comprising a sleeve 20 carrying a helical blade 21 formed integrally therewith and intended to act as a conveyor for the viscous fluid undergoing travel through the interior of the inner tube of a tube heat exchanger whose tube construction is not shown in FIG. 3 but will typically be analogous to that in FIG. 2. The sleeve 20 is mounted on a compound shaft 23 which is shown in greater detail here than is the shaft 9 in FIG. 2 and comprises coupling arrangements 24 and 25 at its respective ends, coupling arrangement 24 being used for coupling the shaft to rotary drive means and coupling means 25 being used for coupling the shaft to a suitable support means. The shaft itself is of double tube construction comprising an inner tube 26 and an outer tube arrangement 27 to one end of which one end of the sleeve 20 is welded. At its other end the sleeve 20 is welded to the coupling arrangement 24. An annular passage 28 exists between inner tube 26 and outer tube arrangement 27 and sleeve 20 and serves for introduction of heat exchange medium to provide additional cooling of viscous fluid conveyed by the helical blade 21 from left to right in the sense of FIG. 3 to that achieved by heat exchange medium in the outer of the heat exchange tubes (not shown). This additional heat exchange medium enters the annular passage 28 to pass in counterflow to the viscous medium before entering a cylindrical chamber 30 at the left hand end of the heat exchanger through openings 31 to pass thence into cylindrical passage 29 in the interior of inner tube 26 to flow therethrough and out of the shaft 23 at 32. The portion of tube 26 within sleeve 20 passes through a cylindrical support body 33 to which the sleeve 20 is attached by spot welding as shown at 34.

By using the apparatus of FIG. 3 within a heat exchanger of the type shown in FIG. 1, it is the drive imparted to the compound shaft 23 which is responsible for conveying of the viscous medium through the heat exchanger while at the same time the helical blade 21 provides the required scraping effect against the interior wall surface of the inner tube of the heat exchanger thereby removing from that surface material which has recently undergone heat exchange with the heat exchange medium in the outer chamber and achieving presentation for heat exchange of a fresh supply of viscous medium.

Although the apparatus of FIG. 3 has been described particularly with respect to the enhancing of conveying and cooling of a viscous medium which would normally be expected to undergo viscosity increase and temperature increase as it passes through the heat exchanger, it should be appreciated that variants in the operation and use of the heat exchanger may be contemplated. Thus, the internal cooling may be directed into the compound shaft 23 at 32 to pass initially through inner tube 26 to leave the shaft arrangement through annular passage 28. Moreover, the apparatus can be used conveniently with any medium which is to undergo heat exchange with a heat exchange fluid, whether it is to undergo heating or cooling. It is not limited to the above described use with viscous media.

To reduce problems of insufficient heat transfer to viscous materials undergoing conveying as a result of scale formation on the heat transfer surface caused by materials being conveyed, enhanced scraping at the surface and hence improved heat transfer is achieved as a result of the helical blade shown as helical rib at 21 in FIG. 3 being modified as shown in FIGS. 4 and 5. Thus the rib is formed with a slot 40 running along its entire length and angled against the direction of flow of the fluid medium. The slot extends from an interior passage 41 of circular cross-section in which is located the undersized cylindrical root 42 of a flexible thin fin arrangement 43 of metal or plastics which projects out of the slot 40 to provide an edge 44 in contact with heat exchanger inner wall 45. As can be seen from FIG. 5 a series of individual fins 46 with gaps 47 therebetween can be located in the slot 40. With such an arrangement, with a helical flight angled in the upstream direction, one surface of the blade arrangement presses against the stationary inner tube surface 45. Not only is better scraping action then achieved, but material passing over the flight will be reduced or stopped and hence the pump or drive action of the overall helical blade arrangement will be improved. With such an arrangement which is not shown to scale, the depth of rib 21 will be typically about 10 mm. the projecting height of each fin about 3–5 mm and its width 10–20 mm.

Whether a single blade-providing fin or a plurality of fins is provided, feeding thereof into the slot 40 will take place from one end thereof. Passage 41 allows the fins to pivot slightly so that, as the shaft rotates and pushes the process material forwards, the consequent pressure difference across the flight of the fins forces the blades against the stationary outer wall, thus achieving the clean scraping action required and minimising back leakage of the material being processed.

The gaps 47 between the fins 46 are fixed by having short lateral extensions of the rounded ends or roots 42 beyond the width of the fins. These gaps are chosen according to application to allow some degree of extra mixing or "working" of the material being processed. Such design also allows the fins to rotate and hence move back towards the wall surface as the edges 44 wear.

We claim:

1. A scraped surface heat exchanger comprising a pair of concentric heat exchanger tubes with a scraper blade-carrying shaft being disposed axially within the inner of the tubes and adapted for connection to rotational drive means, inlet and outlet means being provided to both a chamber defined by the inner tube and to an annular chamber formed between the two tubes, in which heat exchanger a helical scraper blade arrangement extends along the length of the shaft within the inner chamber, which blade arrangement includes a helical slot angled against the direction of flow of the fluid medium provided on said shaft and in which is set thin strip-form metal or plastics material which presses against the internal surface of the inner tube with a contact sufficient to allow the shaft to rotate within the inner tube when the blade arrangement is conveying through the inner tube a fluid medium to undergo heat exchange with a heat exchange medium in the outer chamber.

2. A heat exchanger according to claim 1, wherein the blade arrangement is provided on a hollow shaft which is adapted for coupling to a supply of heat exchange medium for supply to the interior of the shaft of heat exchange medium for enhancing the heat exchange effect of the said heat exchange medium in the outer chamber.

3. A heat exchanger according to claim 2, wherein the blade arrangement is provided on a compound shaft comprising an outer tube arrangement and an inner tube defining an annular passage therebetween for supply of heat exchange medium and for return of heat exchange medium down the inner tube.

4. A heat exchanger according to claim 3 which is arranged for supply of heat exchange medium through the compound shaft in counter-flow to the direction of conveying of the fluid medium over the helical blade arrangement.

5. A heat exchanger according to claim 1, wherein the thin metal or plastics strip-form material is in the form of a series of blades set at intervals in the slot and separated by gaps which are short in relation to the length of the blades.

6. A method of effecting heat exchange between a heat exchange medium and a medium which is to undergo heat exchange with such medium in a heat exchanger under conditions such that the latter medium will increase in viscosity as it passes through the heat exchanger, which comprises conveying the latter medium through the interior of the inner of a pair of concentric tubes between which flows a heat exchange medium, under the action of a rotating helical scraper blade arrangement against one surface of which the fluid medium presses, said one surface being provided by thin strip-form metal or plastics material set in a helical slot on a shaft carrying the blade arrangement, the slot being angled against the direction of flow of the fluid medium and said thin strip-form metal or plastics material making intimate contact with the inner wall surface of the inner of the concentric tubes.

7. A method according to claim 6, wherein the helical blade arrangement is provided on a hollow shaft providing a passage for circulation of a further body of heat exchange medium at the interior thereof to augment the heat exchange action of said heat exchange medium.

8. A method as claimed in claim 7, wherein the further body of heat exchange medium is supplied in counter-current to the direction of travel of the medium which is to undergo heat exchange.

9. A method as claimed in claim 6, which comprises providing the thin strip-form metal or plastics material in the form of a series of blades set out at intervals in the slot and separated by gaps which are short in relation to the length of the blades.

* * * * *